United States Patent [19]

Calegan

[11] 4,170,884

[45] Oct. 16, 1979

[54] PERMUTATION CONTROLLED PADLOCK

[75] Inventor: Everett L. Calegan, Homewood, Ill.

[73] Assignee: Junkunc Bros. American Lock Company, Crete, Ill.

[21] Appl. No.: 881,011

[22] Filed: Feb. 24, 1978

[51] Int. Cl.[2] ..... E05B 37/10

[52] U.S. Cl. ..... 70/21; 70/25; 70/314

[58] Field of Search ..... 70/21, 22, 24, 25, 26, 70/302, 314

[56] References Cited

U.S. PATENT DOCUMENTS

| | | | |
|---|---|---|---|
| 1,369,850 | 3/1921 | Steen | 70/25 |
| 2,441,895 | 5/1948 | Miller | 70/289 |
| 3,563,067 | 2/1971 | Foote | 70/25 |
| 4,055,972 | 11/1977 | Calegan | 70/21 |

*Primary Examiner*—Robert L. Wolfe

*Attorney, Agent, or Firm*—Hill, Van Santen, Steadman, Chiara & Simpson

[57] ABSTRACT

Permutation and key-operated padlock having a driver tumbler formed integrally with its tumbler post. The tumbler post extends through the top face of the padlock casing and is retained to the dial knob for dialing the tumblers by a spinning operation to form an integral dial knob and tumbler post assembly which cannot be removed from the casing by unauthorized efforts to release the shackle. The permutation mechanism includes the driver tumbler and driven tumblers freely rotatable on the tumbler post and biased into engagement with each other. A spindle for the driven tumblers extends within the tumbler post and the driver and driven tumblers have the usual axially extending driver lugs to rotate said tumblers upon movement of the driver tumblers to the correct combination numbers and align radially extending slots in the tumblers to receive a tongue from a rocker carrying a latch bolt and accommodate release movement of said rocker and release of the latch bolt from the shackle. The shackle has a one-piece upsetter on its longer leg having one arm upsetting the innermost driven tumbler upon outward movement of the shackle and misaligning the tumbler slots. The upsetter has a second upsetter arm engaging an upsetter lug on the driven tumbler to move the last number of the combination on the dial out of registry with the combination marker on the lock casing. A spring extends across the padlock casing and engages the casing at one end and the rocker at its opposite end to move the rocker tongue out of the tumbler slots when aligned and accommodate release of the shackle.

7 Claims, 6 Drawing Figures

PERMUTATION CONTROLLED PADLOCK

BACKGROUND, SUMMARY AND ADVANTAGES OF INVENTION

Permutation releasable shackle-type padlocks having a latch bolt slidably carried in a rocker biased into locking engagement with a retaining notch in the short leg of the shackle are in common use at the present time. In many prior designs of such padlocks, such as those illustrated in the U.S. Pat. Nos. 2,148,226 to Aldeen and 3,563,067 to Foote and in the U.S. Pat. Nos. 2,926,514 to Junkunc and 4,055,972 to Calegan assigned to the assignee of the present invention, a spring-biased latch bolt slidably carried in a rocker secures a shackle in a locked position when the rocker tongue engages the peripheries of the tumbler disks.

In such padlocks, except Aldeen U.S. Pat. No. 2,148,226, the driver tumbler is mounted to turn with the dial knob and the tumblers driven thereby are carried on a spindle within the padlock casing and biased into engagement with each other and with the driver tumbler by a spring.

It has been difficult to obtain sufficient spring pressure to release the rocker tongue carrying the latch bolt from the aligned slots of the tumblers when the tumbler slots become aligned, and the shackle is pulled outwardly of the padlock casing, to release the lock and pivot the rocker to position the latch bolt into position to lockingly engage the locking notch in the short leg of the shackle, as the shackle is inserted in the padlock casing.

Most prior padlocks also have an upsetter made of many parts, to upset the tumblers as the shackle is pulled outwardly of the padlock casing, and do not make adequate provision for upsetting the driver tumbler and last number dialed on the combination dial, except where a driver lug may come into engagement with the driver lug of the driver tumbler, upon upsetting of the padlock. This, however, usually is not common.

The advantages of the present invention are that the driver tumbler is formed integrally with its tumbler post and the padlock construction is such as to permanently secure the dial and combination disk to the tumbler post by a spinning operation, so the driver tumbler, its tumbler post, dial knob and combination disk are, in effect, one piece, which is inseparable after the padlock has been assembled, to thereby materially simplify the construction and assembly of the padlock, and increase the security thereof.

A further advantage in the invention is in the use of a single spring extending across the tumbler post for releasing the rocker tongue from the aligned tumbler slots and positioning the rocker into position to position the latch bolt carried by the rocker to reengage the shackle as the shackle is moved within the padlock casing.

A still further advantage in the invention is in the use of a one-piece upsetter rectilinearly guided within the padlock casing which positively upsets the inner driven tumbler as the shackle is moved into its open position, and upsets the driver tumbler as the shackle is moved within the padlock casing and moves the last number of the combination out of registry with the dial marker on the padlock casing.

A further advantage of the invention is to provide a simpler security permutation padlock utilizing a minimum of moving parts and so arranged that the latch bolt may also be released by a key.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure.

DESCRIPTION OF PREFERRED EMBODIMENT OF INVENTION

Figure 1:
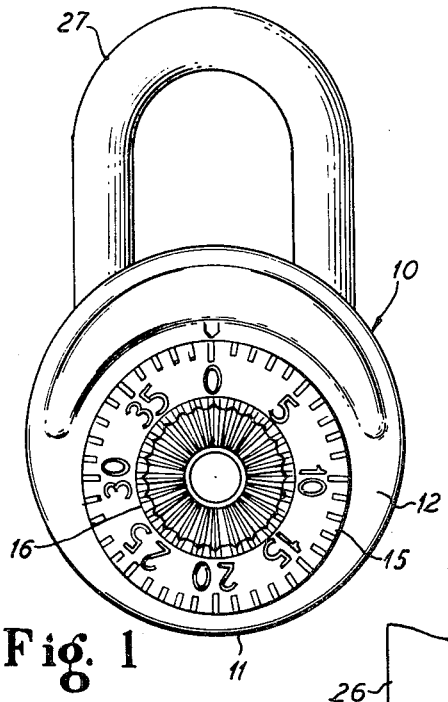
FIG. 1 is a plan view of a padlock constructed in accordance with the principles of the present invention looking at the dial and dial knob of the padlock.

In the embodiment of the invention illustrated in the drawings, a generally cylindrical padlock casing 10 is shown as including an outer casing 11 having a recessed outer or dial plate 12, for receiving a combination dial 15 and knob 16 formed integrally therewith. The padlock also has an inner casing 17 generally conforming to the outer casing and having a front wall 18 abutting the dial plate 12. The inner casing 17 is shown as having a generally cylindrical side wall 13 extending along the side wall 19 of the outer casing and terminating at the back of the padlock to receive a back plate 21. The back plate 21 may be in two parts, the smaller of which parts carries a key cylinder 22 for a key plug and transmission plate 23 extending from the key cylinder and pivoted upon insertion of a key in the key slot of the key cylinder to release a latch bolt 24 from a locking notch 25 formed in a short leg 26 of a shackle 27. The back plate 21, key plug, key cylinder 22, transmission plate 23 and latch bolt 24 are like those shown in my U.S. Pat. No. 4,055,972, dated Nov. 1, 1977, so need not herein be shown or described further.

It should further be understood that while the wall 11 of the padlock casing is characterized as being cylindrical, it need not necessarily be cylindrical, but may be of any form conventionally used in padlocks.

The latch bolt 24 is slidably carried in a rocker 29 of a conventional form, and biased outwardly into locking engagement with the locking notch 25 as by a spring 30. The spring 30 is seated at its inner end in the bottom of a socket 31 in the rocker 29 as in my aforementioned prior U.S. Pat. No. 4,055,972, a copy of which is filed herewith an incorporated herein as a part of the present specification.

The rocker 29 is pivoted in the padlock casing on a pivot pin 32 carried between the front and back plates of the inner casing 17. The latch bolt may also have an ear (not shown) projecting laterally from one side thereof adjacent the nose of the latch bolt, to be engaged by the transmission plate 23 as a key is placed in the key plug, to turn the plug and transmission plate as in my aforementioned U.S. Pat. No. 4,055,972.

Figure 2:
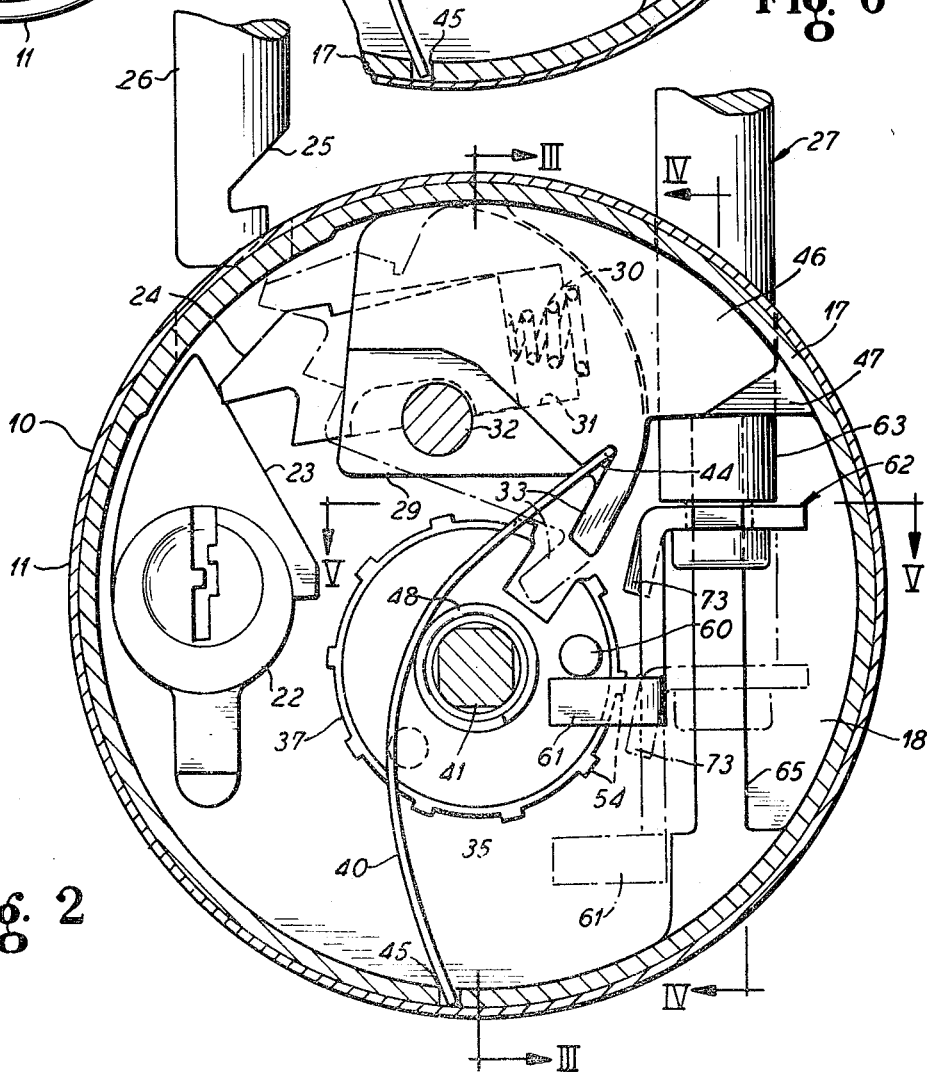
FIG. 2 is a sectional view taken through the padlock of FIG. 1 and the spindle for the driven tumbler disks with the tumbler slots in alignment, in order to illustrate certain details of the invention.

A tongue 33 extends inwardly of the rocker 29 towards the center of the padlock casing for engagement with the peripheral surfaces of one or more permutation or tumbler disks 35, 36, 37, to restrict the latch bolt 24 to a shackle securing orientation, whenever the disks 35, 36, 37 and slots 39 in each of said tumbler disks are out of registry with each other, except by the use of a key, and to accommodate release of the latch bolt from the locking notch 25 when said slots are in alignment with each other as the proper combination is dialed, as shown in FIG. 2.

Figure 6:
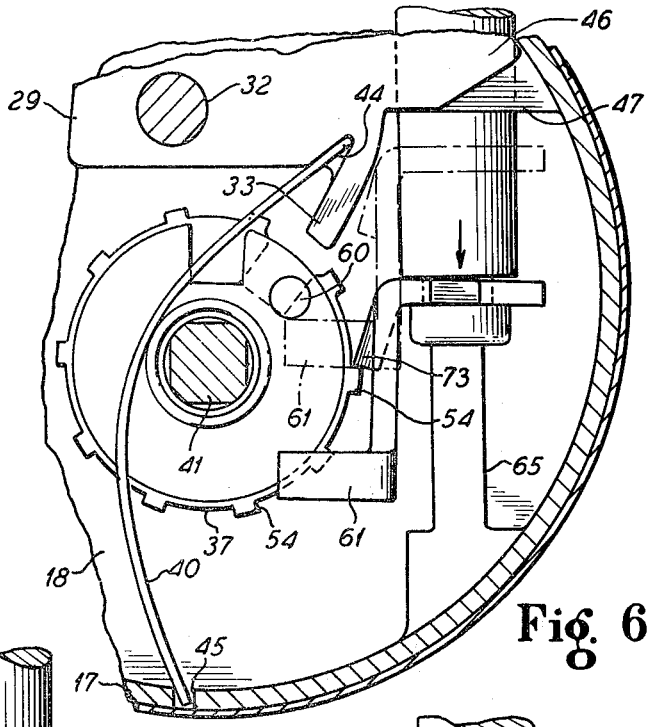
FIG. 6 is an enlarged partial fragmentary sectional view of the padlock and its casing illustrating the padlock in its locked position illustrating certain details of the upsetter not shown in FIG. 2.

Upon inward movement of the shackle 27 to lock the padlock, the rocker 29 is retained in the position shown by solid lines in FIGS. 2 and 6 by a long spring 40, shown as being a wire spring, but not necessarily wire. The long spring 40 gives a relatively strong spring action to snap the rocker into engagement with the wall of the inner casing and move the tongue 33 out of the slots 39 in the tumblers when aligned and to retain the rocker in position to accommodate locking movement of the padlock upon inward movement of the shackle 27.

Figure 3:
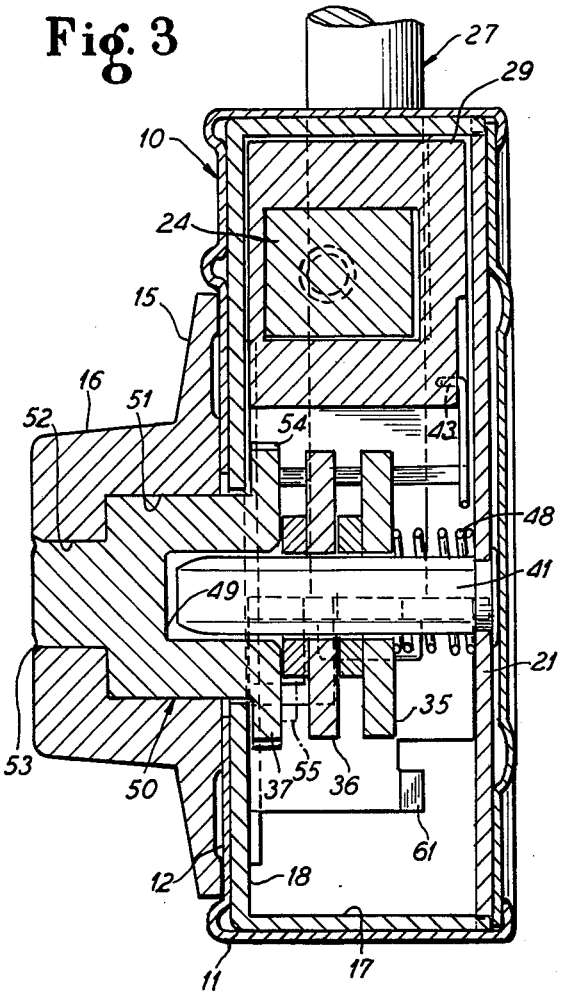
FIG. 3 is a fragmentary sectional view taken substantially along line III—III of FIG. 2 showing the tumbler mechanism, driver tumbler post, combination and dial knob and the casing for the padlock in section.
Figure 4:
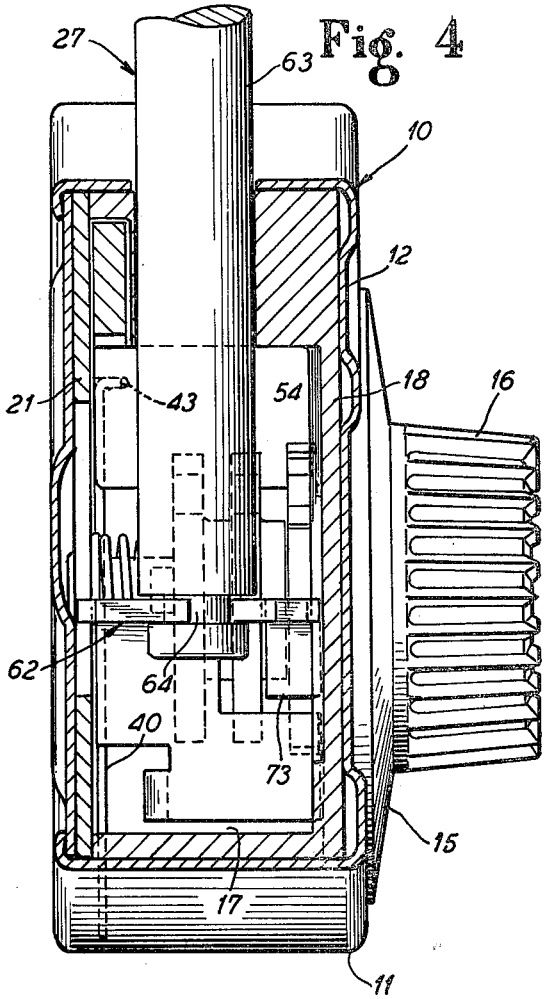
FIG. 4 is a sectional view taken substantially along line IV—IV of FIG. 2 showing certain details of the upsetter and guide therefor.

As shown in FIGS. 2, 4 and 6, the spring 40 extends across a spindle 41 for the tumbler disks 35 and 36 and has a right-angled end portion 43 (FIGS. 3 and 4) engageable within a slot 44 (FIG. 2) formed in the rocker 29 adjacent the tongue 33, and has an opposite end portion engageable within an inwardly opening notch 45 formed in the side wall of the inner casing 17 (FIGS. 2 and 6). This affords increased spring pressure over the springs formerly used for the same purpose, and thereby assures the positioning of the rocker 29 in position to accommodate locking of the padlock upon inward movement of the shackle 27 as well as the snapping of the tongue 33 out of the tumbler notches 39 when aligned.

The rocker 29 also has a stabilizing and stop segment 46 formed integrally therewith and extending therefrom along the inside of the side wall of the inner casing 17 along one side of a back-up guide 47 to stabilize rocking movement of the rocker and serve as a stop to limit inward movement of the shackle beyond its locking position and prevent release of the latch bolt by cyclic tapping on the shackle or by a heavy blow on the shackle, as well as to provide lateral stability for the rocker as in the Lippisch U.S. Pat. No. 3,990,275, dated Nov. 9, 1976 and accompanying this specification and incorporated herein as a part hereof, and no part of the present invention so not shown or described in detail.

The spindle 41 is mounted at one end in the back plate 21 for the padlock casing in a conventional manner and is encircled at its inner end by a compression spring 48 disposed between the back plate 21 and the inner tumbler 35, to bias the tumblers 35, 36 and 37 into engagement with each other. The spindle 41 also extends within an inwardly opening socket 49 a substantial distance therealong and above the outer plate 12 of the padlock casing. The socket 49 is formed in a tumbler post 50 for the knob 16 and combination disk 15 (FIG. 3).

The tumbler post 50 may have a flat (not shown) engaging a similar flat in a socket 51 formed in the dial knob 16. The socket 51 opens to the outer end of the dial knob 16 and has a reduced diameter outer end portion 52 having a beveled outer end portion 53. The tumbler post 50, as shown in FIG. 2, conforms to the socket 51 and initially extends a slight distance outwardly of the outer end of the knob 16, to provide sufficient stock to secure the tumbler post to said knob 16 as by a spinning operation, spinning the outer end of the tumbler post flush with the outer end of the knob and into the beveled outer end portion of the socket 51. The spinning of the outer end of the tumbler post 50 to the knob 16 thus provides a positive connection between the tumbler post and knob and, in effect, forms the knob 16, dial 15, tumbler post 50 and tumbler disk 37 into an integral assembly, preventing removal of said knob 16, combination disk 15 and tumbler disk 37 from each other and from the padlock casing.

The tumbler disk 37, as shown in FIG. 3, is commonly termed a driver tumbler disk and may be a bottom tumbler disk during assembly of the tumbler disks 35 and 36 on the spindle 41. Said tumbler disk 37 has the usual upsetter lugs 54 extending radially from the periphery thereof and also has at least one driver lug 55 extending axially therefrom, offset from the center thereof, for engagement with a driver lug 56 extending axially of the tumbler disk 36 toward the driver tumbler disk 37 as the knob 16 and dial 15 are turned to the proper combination numbers.

Figure 5:
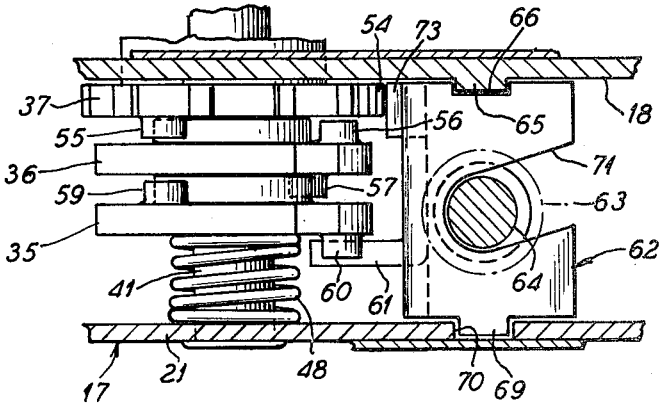
FIG. 5 is a sectional view taken substantially along line V—V of FIG. 2, illustrating certain details of the upsetter for the driver tumbler and driven tumblers not shown in FIG. 2.

The tumbler disk 36, as shown in FIG. 5, has a driver lug 57 extending axially therefrom toward the tumbler disk 35 for engagement with a lug 59 extending axially of the tumbler disk 35 toward the tumbler disk 36, as clearly shown in FIG. 5. The tumbler disk 35 also has an upsetter lug 60 extending from the opposite face thereof from the lug 59 and engaged by an upsetter arm 61 on an upsetter 62, pivotally mounted in a groove 64 adjacent the lower end of a leg 63 of the shackle 27, and commonly termed the long leg of the shackle.

The upsetter arm 61 is spaced a substantial distance from the inner end of the long leg of the shackle and is shown in FIGS. 3 and 6 as extending inwardly of the shackle at right angles with respect thereto to engage the lug 60 upon outward movement of the shackle to its release position (FIG. 2), and misalign the tumbler slots 39 as the shackle is released.

The upsetter 62 is guided for rectilinear movement along the inside of the casing 10 upon inward and outward movement of the shackle 63, as by a gib 65 extending inwardly of the front plate 18 of the inner casing 17, and engaging a corresponding guide recess 66 formed in said upsetter (FIG. 5).

The upsetter 62 also has a gib 69 extending toward the back plate of the inner casing 17 and slidably engageable with a corresponding rectilinear recess 70 formed in the back plate 21 of the padlock casing.

The upsetter 62 further has a diagonal slot 71 opening to the outer wall of the inner casing and has an inner end generally conforming to the circumferential periphery of the groove 64 adjacent the lower end of the long leg of the shackle, to afford ready assembly of the upsetter to the shackle prior to assembly of the inner casing 17 to the outer casing 11.

As shown in FIG. 3, the upsetter 62 has an upsetter arm 73 extending therefrom in an angular inward direction toward the driving tumbler disk 37 for engagement with one of the upsetter lugs 54 extending radially of the periphery of the driver tumbler disk 37 upon movement of the shackle inwardly of the padlock casing, to engage the locking notch 25 with the latch bolt 24.

Upon outward movement of the shackle to release the padlock, the arm 61 engaging the lug 60 will upset the tumbler disk 35 and one or more of the adjacent tumbler disks 36 or 37, to misalign the slots 39 with each other and prevent the tongue 33 from entering any of said slots.

Upon inward movement of the shackle, the upsetter arm 73 will engage an upsetter lug 54 projecting from the periphery of the driving tumbler 37, and move the dial away from the last number of the combination and also assure that the slots 39 are out of alignment until the proper combination has been dialed (FIG. 6).

It should be understood from FIGS. 2, 4, 5 and 6 that this is attained by providing clearance between the guides 65 and 66 and 69 and 70, and providing a relatively loose connection between the upsetter and shackle to provide sufficient slop to accommodate the upsetter arm 73 to pass by an upsetter lug 54 upon outward movement of the shackle, and to accommodate angular movement of the upsetter relative to the shackle and casing and pivot in an opposite direction and positively engage said upsetter arm with a lug 54 upon inward movement of the shackle, to move the dial off the last number of the combination.

A one-piece upsetter has thus been provided upsetting the last number dialed to release the padlock, upon inward movement of the shackle to lock the padlock and upsetting the tumblers 35 and slot 39 therein upon outward movement of the shackle.

I claim as my invention:

1. In a permutation padlock of the type having an outer casing and an inner casing generally conforming to said outer casing, in which the casings have coextensive side walls having parallel spaced aligned shackle-guiding and receiving openings therein, a U-shaped shackle slidably guided in said openings and having a long leg and a shorter leg having a latch bolt receiving locking notch therein, said outer casing having a wall forming a front cover for the padlock, a tumbler spindle carried by said inner casing and extending above said front wall of said outer casing, a dial post pivotally movable about said tumbler post, a dial and knob on said dial post and operable to turn said dial post, a driver tumbler within said casing on said tumbler post and turned upon turning movement thereof, said driver tumbler having a plurality of upsetter lugs extending radially therefrom and having a driver extending axially therefrom and radially offset from the center thereof, driven tumblers on said tumbler spindle having driver members extending axially from opposite sides thereof, said tumblers each having an outwardly opening slot therein, spring means encircling said spindle and biasing said tumblers into engagement with each other, a rocker assembly pivoted within said casing and having a latch bolt slidably mounted therein and biased to lockingly engage said locking notch and having a tongue extending therefrom engageable with said slots when aligned, the improvements comprising:

a one-piece upsetter loosely mounted on the long leg of said shackle and guided for rectilinear movement along the casing and having one arm adapted to engage a driver pin on the innermost of said tumblers to upset said tumblers upon release of the shackle from the latch bolt and a second arm adapted to move the last number of the combination dial away from the position dialed to accommodate opening of the padlock.

2. The padlock of claim 1 in which the upsetter tilts in a direction to pass by the upsetter lugs upon outward movement of the shackle and engage an upsetter lug upon inward movement of the shackle.

3. The padlock of claim 2 in which the upsetter arms are integral and spaced apart distances sufficient to upset the driver member on the inner of said tumblers upon movement of the shackle to open the padlock, and upset the driver tumbler and dial upon movement of the shackle to lock the padlock.

4. The padlock of claim 3 in which the upsetter arm engaging the driver pin on the innermost of said tumblers extends at right angles with respect to the shackle beneath the inner end thereof towards the center of the padlock, and the upsetter upsetting the driver tumbler and dial extends angularly inwardly towards the driver tumbler.

5. The padlock of claim 1 in which the driver tumbler and tumbler post are integrally formed and the tumbler post is permanently connected to the knob, dial and front wall of the padlock casing and is pivotally movable with respect to the front wall of the padlock casing, to dial the preselected permutation numbers to open the padlock.

6. The padlock of claim 5 in which the integral forming of the tumbler post to the knob and dial comprises a socket extending entirely through the knob for receiving the tumbler post and having a beveled outer end and the connection of the dial post to the knob is by spinning the dial post to the beveled outer end of the socket.

7. In a permutation padlock of the type having an outer casing and an inner casing generally conforming to said outer casing, in which the casings have coextensive side walls having parallel spaced aligned shackle-guiding and receiving openings therein, a U-shaped shackle slidably guided in said openings and having a long leg and a shorter leg having a latch bolt receiving locking notch therein, said outer casing having a wall forming a front cover for the padlock, a tumbler spindle carried by said inner casing and extending above said front wall of said outer casing, a dial post pivotally movable about said tumbler post, a dial and knob on said dial post and operable to turn said dial post, a driver tumbler within said casing on said tumbler post and turned upon turning movement thereof, said driver tumbler having a plurality of upsetter lugs extending radially therefrom and having a driver extending axially therefrom and radially offset from the center thereof, driven tumblers on said tumbler spindle having driver members extending axially from opposite sides thereof, said tumblers each having an outwardly opening slot therein, spring means encircling said spindle and biasing said tumblers into engagement with each other, a rocker assembly pivoted within said casing and having a latch bolt slidably mounted therein and biased to lockingly engage said locking notch and having a tongue extending therefrom engageable with said slots when aligned, upsetter means on the long leg of said shackle adapted to misalign said slots as the shackle is moved to an open position, and move said dial off of the last number of the combination as the padlock is closed, the improvements comprising:

a relatively long spring extending across said padlock casing past said tumbler spindle and connected at one end to said rocker assembly adjacent said tongue and at its opposite end to the inner wall of said casing, said rocker assembly having a socket opening along said tongue and the inner wall of said casing having a notch therein, said long spring having a hooked end engageable within said socket and an opposite end engageable with said notch in said casing, to move said rocker assembly into engagement with the inner wall of said casing with a snap action and positively hold said latch bolt in position to engage said locking notch in the short leg of said shackle as the shackle is pushed within said casing.

* * * * *